US012578132B2

(12) United States Patent
Zhao et al.

(10) Patent No.: US 12,578,132 B2
(45) Date of Patent: Mar. 17, 2026

(54) REFRIGERATION SYSTEM AND REFRIGERATING APPLIANCE

(71) Applicants: QINGDAO HAIER REFRIGERATOR CO., LTD., Shandong (CN); HAIER SMART HOME CO., LTD., Shandong (CN)

(72) Inventors: Yanfeng Zhao, Shandong (CN); Lisheng Ji, Shandong (CN); Xiaobing Zhu, Shandong (CN); Jianquan Chen, Shandong (CN); Yongsheng Sun, Shandong (CN); Xianghui Zhao, Shandong (CN)

(73) Assignees: QINGDAO HAIER REFRIGERATOR CO., LTD., Qingdao (CN); HAIER SMART HOME CO., LTD, Qingdao (CN)

( * ) Notice: Subject to any disclaimer, the term of this patent is extended or adjusted under 35 U.S.C. 154(b) by 122 days.

(21) Appl. No.: 18/575,236

(22) PCT Filed: May 25, 2022

(86) PCT No.: PCT/CN2022/094982

§ 371 (c)(1),
(2) Date: Dec. 28, 2023

(87) PCT Pub. No.: WO2023/273709

PCT Pub. Date: Jan. 5, 2023

(65) Prior Publication Data

US 2024/0288210 A1 Aug. 29, 2024

(30) Foreign Application Priority Data

Jun. 29, 2021 (CN) ..... 202110730153.1

(51) Int. Cl.
*F25B 47/02* (2006.01)

(52) U.S. Cl.
CPC .... *F25B 47/022* (2013.01); *F25B 2400/0403* (2013.01)

(58) Field of Classification Search
CPC ..... F25B 47/022; F25B 2400/0403
(Continued)

(56) References Cited

U.S. PATENT DOCUMENTS

| | | | | |
|---|---|---|---|---|
| 3,218,819 | A | 11/1965 | Croster | |
| 2017/0030615 | A1 | 2/2017 | Kim | |
| 2018/0238603 | A1 * | 8/2018 | Takami | F25B 41/20 |

FOREIGN PATENT DOCUMENTS

| | | | |
|---|---|---|---|
| CN | 103017427 | A | 4/2013 |
| CN | 202853236 | U | 4/2013 |

(Continued)

*Primary Examiner* — Nael N Babaa
(74) *Attorney, Agent, or Firm* — MUNCY, GEISSLER, OLDS & LOWE, P.C.

(57) ABSTRACT

A refrigeration system and a refrigerating appliance. The refrigeration system includes: a refrigeration assembly including a compressor, and an evaporator, forming a refrigeration circuit; and a defrost bypass pipeline connected to the refrigeration circuit for circulating refrigerant from the compressor to generate heat; the defrost bypass pipeline is thermally connected with the evaporator to heat the evaporator. By adding a defrost bypass pipeline connected to the refrigeration circuit and thermally connecting it with the evaporator, the evaporator can be heated for defrosting when the refrigerant from the compressor flows through the defrost bypass pipeline. Since the refrigerant from the compressor can produce a significant amount of heat when passing through the defrost bypass pipeline, this manner of defrosting can enhance the defrosting rate of the evaporator and enable quick, efficient, and thorough defrosting.

11 Claims, 5 Drawing Sheets

(58) Field of Classification Search
USPC ..... 62/140
See application file for complete search history.

(56) References Cited

FOREIGN PATENT DOCUMENTS

| | | | |
|---|---|---|---|
| CN | 203083227 | U | 7/2013 |
| CN | 104121747 | A | 10/2014 |
| CN | 215864171 | U | 2/2022 |
| CN | 216409376 | U | 4/2022 |
| JP | H08193771 | A | 7/1996 |
| JP | 2011231956 | A | 11/2011 |
| KR | 101265190 | B1 | 5/2013 |
| WO | WO 2015043678 | A1 | 4/2015 |

* cited by examiner

REFRIGERATION SYSTEM AND REFRIGERATING APPLIANCE

TECHNICAL FIELD

The present subject matter relates to refrigeration, particularly to a refrigeration system and a refrigerating appliance.

BACKGROUND

Refrigerating appliances, such as refrigerators, freezers, and refrigerated cabinets, use refrigeration systems for cooling. During the operation of refrigeration systems, due to a low temperature, surfaces of an evaporator is prone to frost, which can reduce the cooling efficiency of the evaporator. Therefore, it is necessary to defrost the evaporator timely.

Traditional refrigerating appliances generally install electric heating wires at the bottom of the evaporator. The defrosting process involves first heating the air around the evaporator through electric heating and then transferring the heat to the evaporator. However, this defrosting method has a long cycle, low defrosting rate, high power consumption, and often results in incomplete defrosting, making it difficult to defrost quickly, efficiently, and thoroughly. Additionally, some refrigerating appliances switch the functions of the evaporator and condenser by adjusting a four-way valve. Although the evaporator can defrost using the condensation heat of the refrigerant, this also causes frosting or condensation on the condenser, negatively affecting the overall refrigeration effect of the refrigerating appliance.

SUMMARY

One objective of this invention is to overcome at least one technical defect in prior arts by providing a refrigeration system and a refrigerating appliance.

A further objective is to improve the structure of the refrigeration system for a refrigerating appliance, providing a new defrosting method to increase the defrosting rate of an evaporator and enable the evaporator to defrost quickly, efficiently, and thoroughly.

Another objective is to reduce or avoid high suction temperatures in the compressor caused by the defrosting of the evaporator.

Another objective is to simplify the structure of the refrigeration system, so that a new defrosting scheme enables to implement by using a streamlined structure and simple control method.

According to an embodiment of the present subject matter, a refrigeration system for a refrigerating appliance comprises: a refrigeration assembly comprising a compressor, and an evaporator, forming a refrigeration circuit; and a defrost bypass pipeline connected to the refrigeration circuit for circulating refrigerant from the compressor to generate heat: the defrost bypass pipeline is thermally connected with the evaporator to heat the evaporator.

Optionally, the refrigeration assembly further comprises a condenser set within the refrigeration circuit and connected between the compressor and the evaporator; and the entrance of the defrost bypass pipeline is connected to the outlet of the condenser or the exhaust port of the compressor.

Optionally, the refrigeration assembly further comprises a refrigeration throttling device set within the refrigeration circuit and connected to the inlet of the evaporator: the refrigeration throttling device throttle the refrigerant flowing from the condenser to the evaporator.

Optionally, the system also includes a switching valve connected to the outlet of the condenser and having a valve port connected to the refrigeration throttling device and another valve port connected to the defrost bypass pipeline: the switching valve regulates the flow path of the refrigerant by opening and closing the valve ports connected to the refrigeration throttling device and the defrost bypass pipeline in a controlled manner.

Optionally, the switching valve opens the valve port connected to the refrigeration throttling device when the evaporator is providing cooling, and opens the valve port connected to the defrost bypass pipeline when the evaporator is defrosting.

Optionally, the refrigeration assembly further comprises a return pipe set within the refrigeration circuit and connecting the outlet of the evaporator to the suction port of the compressor.

Optionally, the outlet of the defrost bypass pipeline is connected to the return pipe.

Optionally, the refrigeration system comprises: one or more evaporators; and one or more defrost bypass pipelines, correspondingly one-to-one with each evaporator.

Optionally, the defrost bypass pipeline is either coiled around the evaporator or set up adjacent to the evaporator.

According to another embodiment of the present subject matter, a refrigerating appliance, comprises: a cabinet forming a storage compartment inside; and a refrigeration system of any one of claims 1-9: where the evaporator provides cooling to the storage compartment.

The refrigeration system and refrigerating appliance of the present invention, provides a novel defrosting manner by improving the structure of the refrigeration system. By adding a defrost bypass pipeline connected to the refrigeration circuit and thermally connecting it with the evaporator, the evaporator can be heated for defrosting when the refrigerant from the compressor flows through the defrost bypass pipeline. Since the refrigerant from the compressor can produce a significant amount of heat when passing through the defrost bypass pipeline, this manner of defrosting can enhance the defrosting rate of the evaporator and enable quick, efficient, and thorough defrosting.

Further, in the refrigeration system and refrigerating appliance of the present invention, since the outlet of the defrost bypass pipeline connects to the return pipe of the refrigeration assembly, the refrigerant flowing through the defrost bypass pipeline can return to the suction port of the compressor via the return pipe. This can reduce or avoid the high suction temperature of the compressor caused by the defrosting of the evaporator.

Moreover, the refrigeration system and refrigerating appliance of the present invention, by incorporating the switching valve with one valve port connected to the refrigeration throttling device and another connected to the defrost bypass pipeline, and by opening or closing these ports, enables a simple switch between the defrosting and cooling states of the evaporator, and simplify both the structure and control process of the refrigeration system.

The above and other objects, advantages and features of the present utility model will become more apparent to those skilled in the art from the following detailed description of specific embodiments thereof taken in conjunction with the accompanying drawings.

BRIEF DESCRIPTION OF THE DRAWINGS

Some specific embodiments of the utility model will be described in detail hereinafter by way of example and not by way of limitation with reference to the accompanying drawings. The same reference numerals identify the same or similar components or parts in the drawings. Those skilled in the art should appreciate that the drawings are not necessarily drawn to scale. In the drawings.

DETAILED DESCRIPTION

Figure 1:
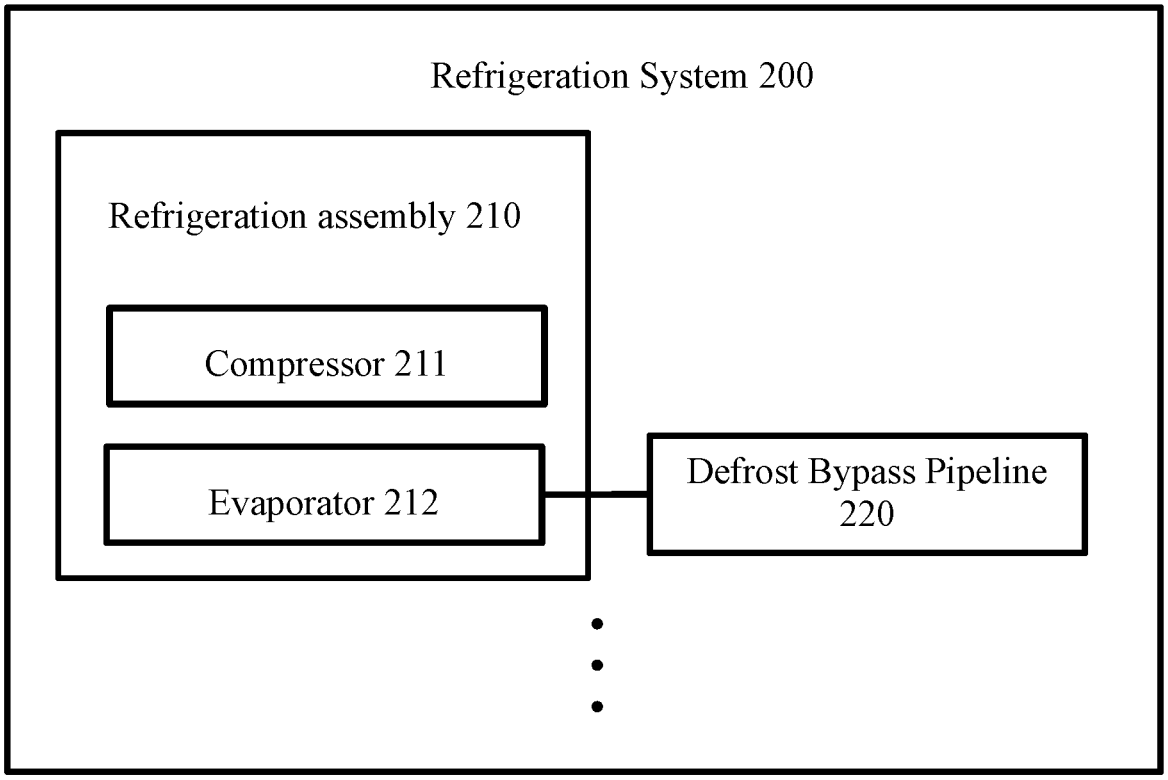
FIG. 1 is a schematic block diagram of a refrigeration system for a refrigerating appliance according to an embodiment of the present subject matter.
Figure 2:
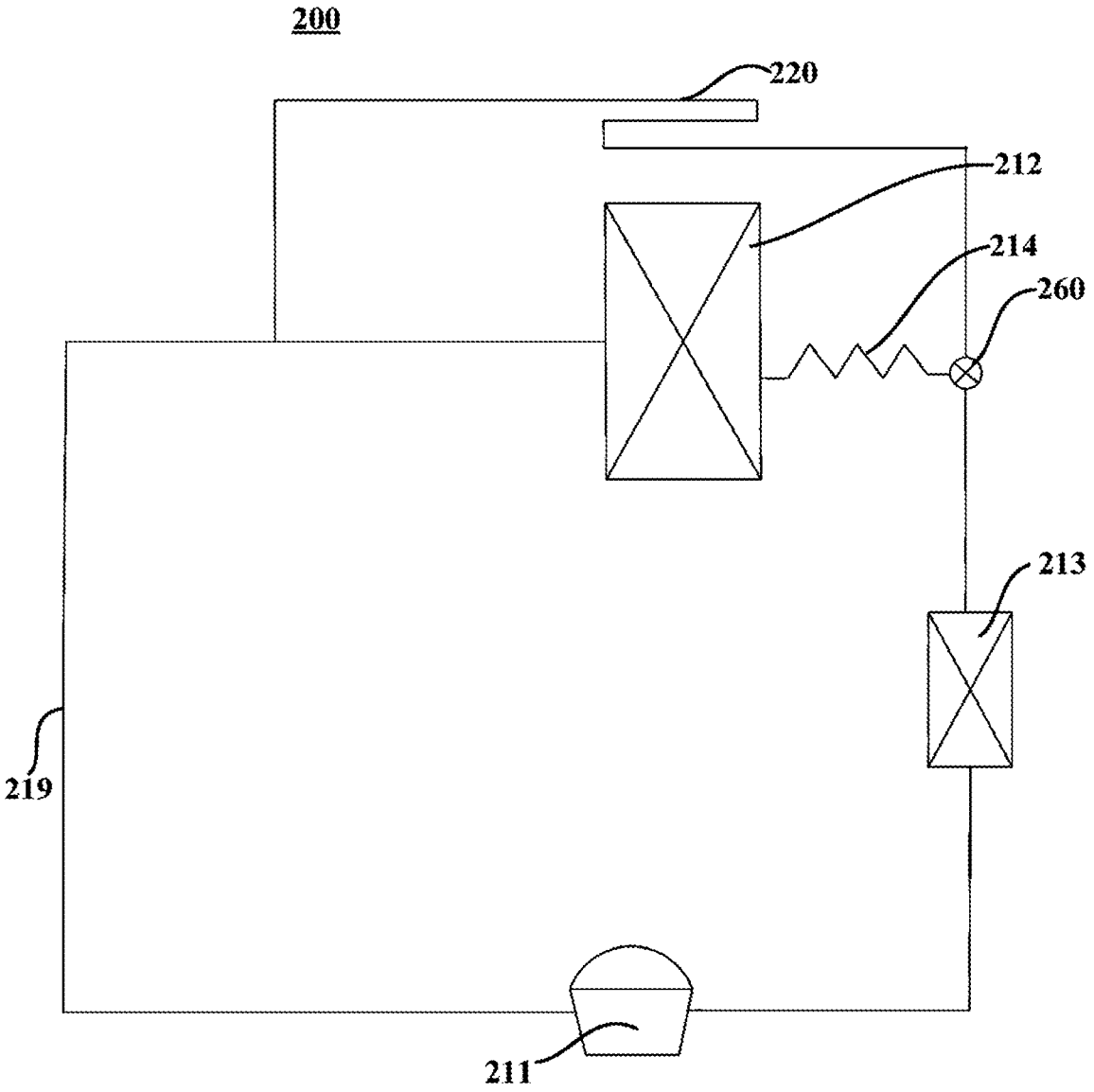
FIG. 2 is a schematic structural diagram of a refrigeration system for refrigerating appliance according to an embodiment of the present subject matter.

FIG. 1 is a schematic block diagram of a refrigeration system 200 for a refrigerating appliance 10 according to an embodiment of the present subject matter. The refrigeration system 200 generally includes a refrigeration assembly 210 and a defrost bypass pipeline 220.

The refrigeration assembly 210 are utilized to form a refrigeration circuit. The refrigeration assembly 210 include a compressor 211 and an evaporator 212. In the absence of defrosting the evaporator, the refrigeration system 200 utilizes the refrigeration circuit for cooling the evaporator 212.

The defrost bypass pipeline 220 is connected to the refrigeration circuit, for example, may be attached to the refrigeration circuit, to form a bypass branch. The refrigeration circuit and the bypass branch can both circulate refrigerant. The refrigeration system 200 modulates the working state of the evaporator 212 by adjusting the flow path of the refrigerant in the refrigeration circuit and the bypass branch. The working states of the evaporator 212 include a cooling state and a defrosting state.

The defrost bypass pipeline 220 is used to circulate refrigerant from the compressor 211 to generate heat. The defrost bypass pipeline 220 is connected to the refrigeration circuit to allow the flow of the refrigerant exiting the compressor 211. For example, an inlet of the defrost bypass pipeline 220 can be connected to an exhaust port of the compressor 211 or to a section downstream of the exhaust port of the compressor 211 via connecting pipelines, as long as it can lead in the high-pressure or high-temperature refrigerant exiting the compressor 211. The refrigerant releases heat during condensation while flowing through the defrost bypass pipeline 220, thereby generating heat.

The above-mentioned connecting pipelines can have the same structure as connecting pipelines between various components within the refrigeration circuit, as long as they can guide the refrigerant. The structure of the defrost bypass pipelines can be roughly the same as condensing tubes of a condenser 213, as long as they can enable the high-pressure or high-temperature refrigerant flowing through them to condense and release heat.

The defrost bypass pipeline 220 is thermally connected to the evaporator 212, so that it can heat the evaporator 212. As the defrost bypass pipeline 220 releases a significant amount of heat when introducing the refrigerant from the compressor 211, thermally by connecting it with the evaporator 212, the heat generated by the defrost bypass pipeline 220 can be transferred to the evaporator 212 and to heat the evaporator 212.

This embodiment introduces a new method of defrosting by improving the structure of the refrigeration system 200. By adding a defrost bypass pipeline 220 connected to the refrigeration circuit and thermally connecting it with the evaporator 212, the evaporator 212 can be heated for defrosting when the refrigerant from the compressor 211 flows through the defrost bypass pipeline 220. Since the refrigerant from the compressor 211 can produce a significant amount of heat when passing through the defrost bypass pipeline 220, this manner of defrosting can enhance the defrosting rate of the evaporator 212 and enable the defrosting to be quick, efficient, and thorough.

Compared with the scheme of directly introducing high-pressure or high-temperature refrigerant flowing out of the compressor 211 into the evaporator 212 to switch the evaporator 212 to a condenser 213, this embodiment uses the defrost bypass pipeline 220 to heat the evaporator 212 for defrosting. This defrosting method can avoid the need for the evaporator 212 to act as a condenser 213, thus reducing or preventing the abrupt cooling or heating of the evaporator 212 and condenser 213 caused by the functional switching of the evaporator 212 and condenser 213, beneficially extending the overall service life of the refrigeration system 200 and reducing maintenance costs.

The defrost bypass pipeline 220 is coiled around the evaporator 212 or is set adjacent to the evaporator 212 to achieve thermal connection. Coiling the defrost bypass pipeline 220 around the evaporator 212 increases the contact area between the defrost bypass pipeline 220 and the evaporator 212, thereby improving the heat transfer efficiency and facilitating rapid defrosting of the evaporator 212. Setting the defrost bypass pipeline 220 adjacent to the evaporator 212 simplifies the process of establishing a thermal connection and reduces manufacturing costs.

The refrigeration assembly 210 also include a condenser 213 set in the refrigeration circuit and connected between the compressor 211 and the evaporator 212. Thus, when the refrigeration system 200 supplies cooling using the refrigeration circuit, the refrigerant exiting the compressor 211 flows through sequentially the condenser 213 and the evaporator 212.

The inlet of the defrost bypass pipeline 220 is connected to either the outlet of the condenser 213 or the exhaust port of the compressor 211. This means that the inlet of the defrost bypass pipeline 220 can be connected to the outlet of the condenser 213 via a connecting pipeline, or it can be directly connected to the exhaust port of the compressor 211.

In the case of the inlet of the defrost bypass pipeline 220 is connected to the outlet of the condenser 213, the refrigerant from the compressor 211 passes through sequentially the condenser 213 and the defrost bypass pipeline 220. As the refrigerant releases its heat through condensation in the condenser 213, this can reduce or avoid significant thermal shock when the refrigerant flows through the defrost bypass pipeline 220, thereby extending the life of the defrost bypass pipeline 220 and reducing maintenance and manufacturing costs. In the case of the inlet of the defrost bypass pipeline 220 is connected to the exhaust port of the compressor 211, the refrigerant does not pass through the condenser 213 and thus releases more heat in the defrost bypass pipeline 220, further enhancing the defrosting rate of the evaporator 212.

The refrigeration assembly 210 also include a refrigeration throttling device 214 set within the refrigeration circuit. The refrigeration throttling device 214 is connected to the inlet of the evaporator 212, and throttles the refrigerant flowing from the condenser 213 to the evaporator 212. For example, the refrigeration throttling device 214 could be arranged between the condenser 213 and the evaporator 212, so when the refrigeration system 200 supplies cooling using the refrigeration circuit, the refrigerant flowing out condenser 213 passes through and is throttled by the refrigeration throttling device 214 before entering the evaporator 212, so that the refrigerant enables to evaporate and absorb heat within the evaporator 212.

The refrigeration system 200 may further include a switching valve 260 set in the refrigeration circuit and connected to the outlet of the condenser 213 or to the exhaust port of the compressor 211. Thus, the inlet of switching valve 260 is connected to the outlet of the condenser 213 or to the exhaust port of the compressor 211.

To elaborate further, let's consider the scenario where the inlet of the switching valve 260 is connected to the outlet of the condenser 213. The switching valve 260 has valve ports connected to the refrigeration throttling device 214 and the defrost bypass pipeline 220. In other words, one valve port of the switching valve 260 connects to the inlet of the refrigeration throttling device 214, and another valve port connects to the inlet of the defrost bypass pipeline 220. These valve ports are understood as the outlets of the switching valve 260 in this and subsequent embodiments.

The switching valve 260 regulates the flow path of the refrigerant by opening and closing of valve ports connected to the refrigeration throttling device 214 and the defrost bypass pipeline 220 in a controlled manner. The switching valve 260 can be a three-way valve, such as a three-way solenoid valve, having one inlet and two outlets. This means that the refrigerant exiting the condenser 213 has two flow paths: one is to flow through the refrigeration throttling device 214 into the evaporator 212, and the other is to flow into the defrost bypass pipeline 220. The switching valve 260 can adjust the flow path of the refrigerant exiting the condenser 213 by opening and closing these valve ports, thereby modulating the working state of the evaporator 212.

The valve ports of the switching valve 260 do not open simultaneously. The switching valve 260 opens the valve port connected to the refrigeration throttling device 214 when the evaporator 212 provides cooling, so as to allow the refrigerant to be throttled before entering the evaporator 212, thereby the evaporator 212 enables to cool using the evaporation heat of the refrigerant. The valve 260 also opens the valve port connected to the defrost bypass pipeline 220 during the defrosting of the evaporator 212, so as to allow the refrigerant existing the condenser 213 to enter the defrost bypass pipeline 220 and release heat in the defrost bypass pipeline 220, thereby the defrost bypass pipeline 220 enables to generate heat. When there are multiple evaporators 212, the switching valve 260 can open the valve port connected to the defrost bypass pipeline 220, and this defrost bypass pipeline 220 is thermally connected to the evaporator requiring defrosting.

In the refrigeration system 200, by incorporating the switching valve 260 with one valve port connected to the refrigeration throttling device 214 and another connected to the defrost bypass pipeline 220, and by opening or closing these ports, the flow path of the refrigerant exiting the condenser 213 can be easily adjusted. This enables a simple switch between the defrosting and cooling states of the evaporator 212, and simplify both the structure and control process of the refrigeration system 200.

The refrigeration assembly 210 may also include a return pipe 219, set within the refrigeration circuit and connecting the outlet of the evaporator 212 to the suction port of the compressor 211. The return pipe 219 is designed to allow the refrigerant to release heat, thereby reducing superheat. For example, the return pipe 219 could be positioned between the outlet of a evaporator 212 and the suction port of the compressor 211.

The outlet of the defrost bypass pipeline 220 connects to the return pipe 219. This means that the refrigerant flowing through the defrost bypass pipeline 220 can return to the suction port of the compressor 211 via the return pipe 219, completing a defrosting cycle.

Since the outlet of the defrost bypass pipeline 220 connects to the return pipe 219 of the refrigeration assembly 210, the refrigerant flowing through the defrost bypass pipeline 220 can return to the suction port of the compressor 211 via the return pipe 219. This can reduce or avoid the high suction temperature of the compressor 211 caused by the defrosting of the evaporator 212. The return pipe 219 of this embodiment also connects to the outlet of the evaporator 212.

In some optional embodiments, the return pipe 219 may not connect to the outlet of the evaporator 212. For instance, it could only connect the outlet of the defrost bypass pipeline 220 to the suction port of the compressor 211, allowing only the refrigerant flowing through the defrost bypass pipeline 220 to pass. The return pipe 219 can also be thermally connected to the evaporator 212. Since the refrigerant also releases heat when flowing through the return pipe 219, the return pipe 219 also can be used to heat the evaporator 212, so that the defrosting rate of the evaporator 212 can be further enhanced.

In the above embodiments, the number of evaporators 212 can be one or more. For example, the number of evaporators 212 can be multiple. Correspondingly, the number of defrost bypass pipelines 220 can also be one or more, each matching a specific evaporator 212. It means, the number of defrost bypass pipelines 220 is the same as the number of evaporators 212, and each evaporator 212 corresponds to a specific defrost bypass pipeline 220. Each evaporator 212 is thermally connected to its corresponding defrost bypass pipeline 220, so that each evaporator 212 enables to be defrosted using its respective defrost bypass pipeline 220.

Figure 3:
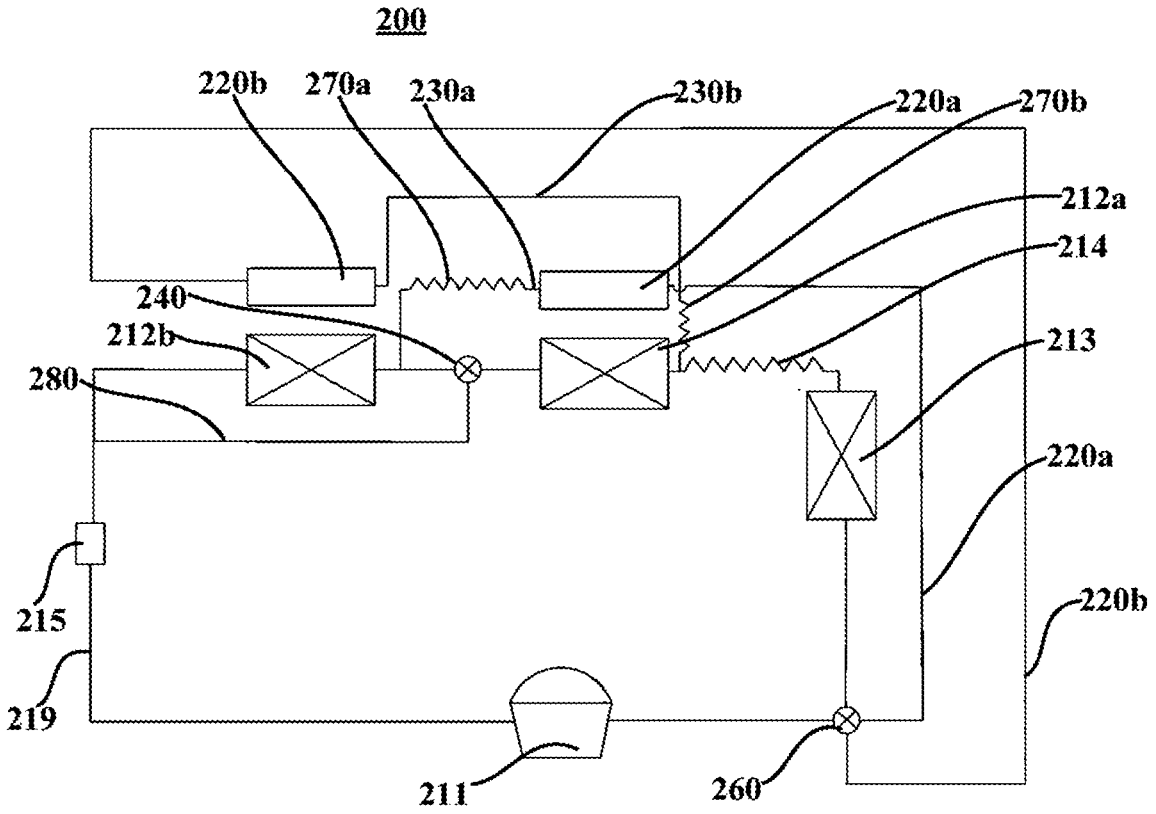
FIG. 3 is a schematic structural diagram of a refrigeration system for refrigerating appliance according to another embodiment of the present subject matter.

FIG. 3 is a schematic structural diagram of a refrigeration system for refrigerating appliance according to another embodiment of the present subject matter. In this embodiment, there are two evaporators, namely a first evaporator 212*a* and a second evaporator 212*b* respectively. It should be noted that this embodiment exemplifies the situation with two evaporators, and those skilled in the art should easily expand upon the number and connection methods of the evaporators based on the understanding of this embodiment, which are not elaborated here.

There are two defrost bypass pipelines 220, namely a first defrost bypass pipeline 220*a* corresponding to the first evaporator 212*a* and a second defrost bypass pipeline 220*b* corresponding to the second evaporator 212*b*. In the refrigeration circuit, the first evaporator 212*a* can be serially connected upstream of the second evaporator 212*b*. Here, terms like "upstream" and "downstream" are relative to the flow path of the refrigerant. And the first evaporator 212*a* is upstream of the second evaporator 212*b*, which means that the refrigerant flows through the first evaporator 212*a* before the second evaporator 212*b*.

In this embodiment, the refrigeration system 200 may further include cooling bypass pipelines, consisting of a first cooling bypass pipeline 230*a* and a second cooling bypass pipeline 230*b*. The first cooling bypass pipeline 230*a* is connected to the first defrost bypass pipeline 220*a* and guides the refrigerant flowing through the first defrost bypass pipeline 220*a* to the second evaporator 212*b*, enabling the second evaporator 212*b* to produce cooling. The second cooling bypass pipeline 230*b* is connected to the second defrost bypass pipeline 220*b* and guides the refrigerant flowing through the second defrost bypass pipeline 220*b* to the first evaporator 212*a*, enabling the first evaporator 212*a* to produce cooling.

The first cooling bypass pipeline 230*a* is connected to an inlet of the second evaporator 212*b* and is equipped with a first bypass throttling device 270*a* used for throttling the refrigerant flowing towards the second evaporator 212*b*. When the first evaporator 212*a* is defrosting using the heat generated by the first defrost bypass pipeline 220*a*, the first cooling bypass pipeline 230*a* utilizes the first bypass throttling device 270*a* to throttle the refrigerant exiting the first defrost bypass pipeline 220*a* and flowing towards the second evaporator 212*b*. That is, while guiding the refrigerant, the first cooling bypass pipeline 230*a* utilizes the first bypass throttling device 270*a* to throttle the refrigerant, so that the throttled refrigerant can evaporate and absorb heat when passing through the second evaporator 212*b*, thereby enabling the second evaporator 212*b* to provide cooling.

The second cooling bypass pipeline 230*b* is connected to an inlet of the first evaporator 212*a* and is equipped with a second bypass throttling device 270*b* used for throttling the refrigerant flowing towards the first evaporator 212*a*. When the second evaporator 212*b* is defrosting using the heat generated by the second defrost bypass pipeline 220*b*, the second cooling bypass pipeline 230*b* utilizes the second bypass throttling device 270*b* to throttle the refrigerant exiting the second defrost bypass pipeline 220*b* and flowing towards the first evaporator 212*a*. That is, while guiding the refrigerant, the second cooling bypass pipeline 230*b* utilizes the second bypass throttling device 270*b* to throttle the refrigerant, so that the throttled refrigerant can evaporates and absorbs heat when passing through the first evaporator 212*a*, thereby enabling the first evaporator 212*a* provide cooling.

The refrigeration system 200 in this embodiment, when one evaporator is defrosting, the refrigerant flowing through the defrost bypass pipeline 220 that heats this evaporator can be supplied to the other evaporator after throttled, so that another evaporator can provide cooling. This cooperative functioning of the two evaporators, combines defrosting and cooling functionalities organically. Thus, it enables the refrigeration system 200 of this embodiment to effectively utilize the mechanical work of the compressor 211, beneficial for improving the energy efficiency of both the refrigeration system 200 and the refrigerating appliance 10.

The refrigeration system 200 in this embodiment may further include a bypass return pipeline 280, which connects an outlet of the first evaporator 212*a* to a suction port of the compressor 211. The bypass return pipeline 280 is used for guiding the refrigerant, which sequentially flows through the second cooling bypass pipeline 230*b* and then the first evaporator 212*a*, to the suction port of the compressor 211 when the second defrost bypass pipeline 220*b* heats the second evaporator 212*b*. In other words, the refrigerant flowing out of the first evaporator 212*a* enables to directly return to the compressor 211 through the bypass return pipeline 280. For example, when the second evaporator 212*b* is being defrosted, the first evaporator 212*a* provides cooling using the refrigerant that flows through the second defrost bypass pipeline 220*b* and to the first evaporator 212*a* via the second cooling bypass pipeline 230*b*. The bypass return pipeline 280 guides the refrigerant flowing out of the first evaporator 212*a* to the suction port of the compressor 211 during the defrosting of the second evaporator 212*b*, thus completing a refrigeration-defrost cycle.

For the convenience of distinction, the switching valve mentioned in the above embodiment can be named the second switching valve 260. The refrigeration system 200 may further include a first switching valve 240 connected to the outlet of the first evaporator 212*a*. The inlet of the first switching valve 240 is connected to the outlet of the first evaporator 212*a*. The first switching valve 240 has a valve port connecting to the second evaporator 212*b* (i.e., the refrigerant flowing out of this valve port can flow towards the inlet of the second evaporator 212*b*), and a valve port connecting to the bypass return pipeline 280 (i.e., the refrigerant flowing out of this valve port can flow towards the bypass return pipeline 280). The first switching valve 240 can be a three-way valve, such as a three-way solenoid valve. The first switching valve 240 can be disposed in the storage compartment 110.

The two valve ports of the first switching valve 240 are not opened simultaneously. The first switching valve 240 is used to open the valve port connecting to the bypass return pipeline 280 when the second defrost bypass pipeline 220*b* heats the second evaporator 212*b* using generated heat, so as to allow the refrigerant to return to the suction port of the compressor 211. And the first switching valve 240 opens the valve port connecting to the second evaporator 212*b* when both the first evaporator 212*a* and the second evaporator 212*b* provide cooling, so as to allow the refrigerant to flow through the second evaporator 212*b* and evaporate while absorbing heat.

In this embodiment, the first evaporator 212*a* and the second evaporator 212*b* are sequentially connected downstream of the exhaust port of the compressor 211. The refrigeration assembly 210 also include a refrigeration throttling device 214 and a condenser 213. The refrigeration throttling device 214 is set in the refrigeration circuit and upstream of the first evaporator 212*a*, and it throttles the refrigerant flowing towards the first evaporator 212*a*. The condenser 213 is connected between the exhaust port of the compressor 211 and the refrigeration throttling device 214. Thus, in this embodiment, the compressor 211, condenser 213, refrigeration throttling device 214, first evaporator 212*a*, and second evaporator 212*b* are sequentially connected to form the refrigeration circuit. In some embodiments, the second cooling bypass pipeline 230*b* can be changed to connect to the inlet of the refrigeration throttling device 214, in this case, a separate bypass throttling device can be omitted from the second cooling bypass pipeline 230*b*. Thereby, it can simplify the structure of the refrigeration system 200.

In these embodiments, the second switching valve 260 can be modified to include an additional valve port. For instance, the second switching valve 260 can be connected to the exhaust port of the compressor 211, that is, the inlet of the second switching valve 260 is connected to the exhaust port of the compressor 211. Specifically, the second switching valve 260 has a valve port connected to the condenser 213 (i.e., the refrigerant exiting this valve port flows towards the condenser 213), a valve port connected to the first defrost bypass pipeline 220*a* (i.e., the refrigerant exiting this valve port flows towards the first defrost bypass pipeline 220*a*), and a valve port connected to the second defrost bypass pipeline 220*b* (i.e., the refrigerant exiting this valve port flows towards the second defrost bypass pipeline 220*b*). The second switching valve 260 can be a four-way valve, such as a four-way solenoid valve, and can be placed within a compressor compartment.

The three valve ports of the second switching valve 260 are not opened simultaneously: The second switching valve 260 is used to open the valve port connecting to the condenser 213 when both the first evaporator 212*a* and the second evaporator 212*b* provide cooling, to allow the refrigerant exiting the compressor 211 to sequentially flow through the condenser 213, the refrigeration throttling device 214, the first evaporator 212*a*, and the second evaporator 212*b*. When the first defrost bypass pipeline 220*a* heats the first evaporator 212*a* using generated heat, the second switching valve 260 opens the valve port connecting to the first defrost bypass pipeline 220*a*, so as to allow the refrigerant exiting the compressor 211 to flow directly into the first defrost bypass pipeline 220*a*, enabling the first evaporator 212*a* to defrost using the heat generated by the first defrost bypass pipeline 220*a*. When the second defrost bypass pipeline 220*b* heats the second evaporator 212*b* using generated heat, the second switching valve 260 opens the valve port connecting to the second defrost bypass pipeline 220*b*, so as to allow the refrigerant exiting the compressor 211 to flow directly into the second defrost bypass pipeline 220*b*, enabling the second evaporator 212*b* to defrost using the heat generated by the second defrost bypass pipeline 220*b*.

By adding the defrost bypass pipeline 220 in the refrigeration system 200 and by arranging the cooling bypass pipelines at the outlet of each evaporator, and by using the first switching valve 240 and the second switching valve 260 to regulate the flow path of the refrigerant in the refrigeration circuit and the bypass branch, the refrigeration system 200 achieves simultaneous defrosting and cooling. Additionally, it effectively utilizes the mechanical work of the compressor 211 and has a compact structure.

The refrigeration system 200 of this embodiment, by using the defrost bypass pipeline 220, cooling bypass pipelines, and switching valves to improve the connection structure of the refrigeration system 200, enables sequentially connected evaporators to defrost without temperature rise, and enhances the preservation performance of the refrigerating appliance 10. This is beneficial for simplifying the structure and the control process of the refrigeration system 200.

In this embodiment, the refrigeration assembly 210 may further include a liquid receiver 215 set within the refrigeration circuit, for example, between the outlet of the second evaporator 212*b* and the suction port of the compressor 211. The liquid receiver 215 is used for regulating the amount of refrigerant required by the various components of the refrigeration assembly 210.

Figure 4:
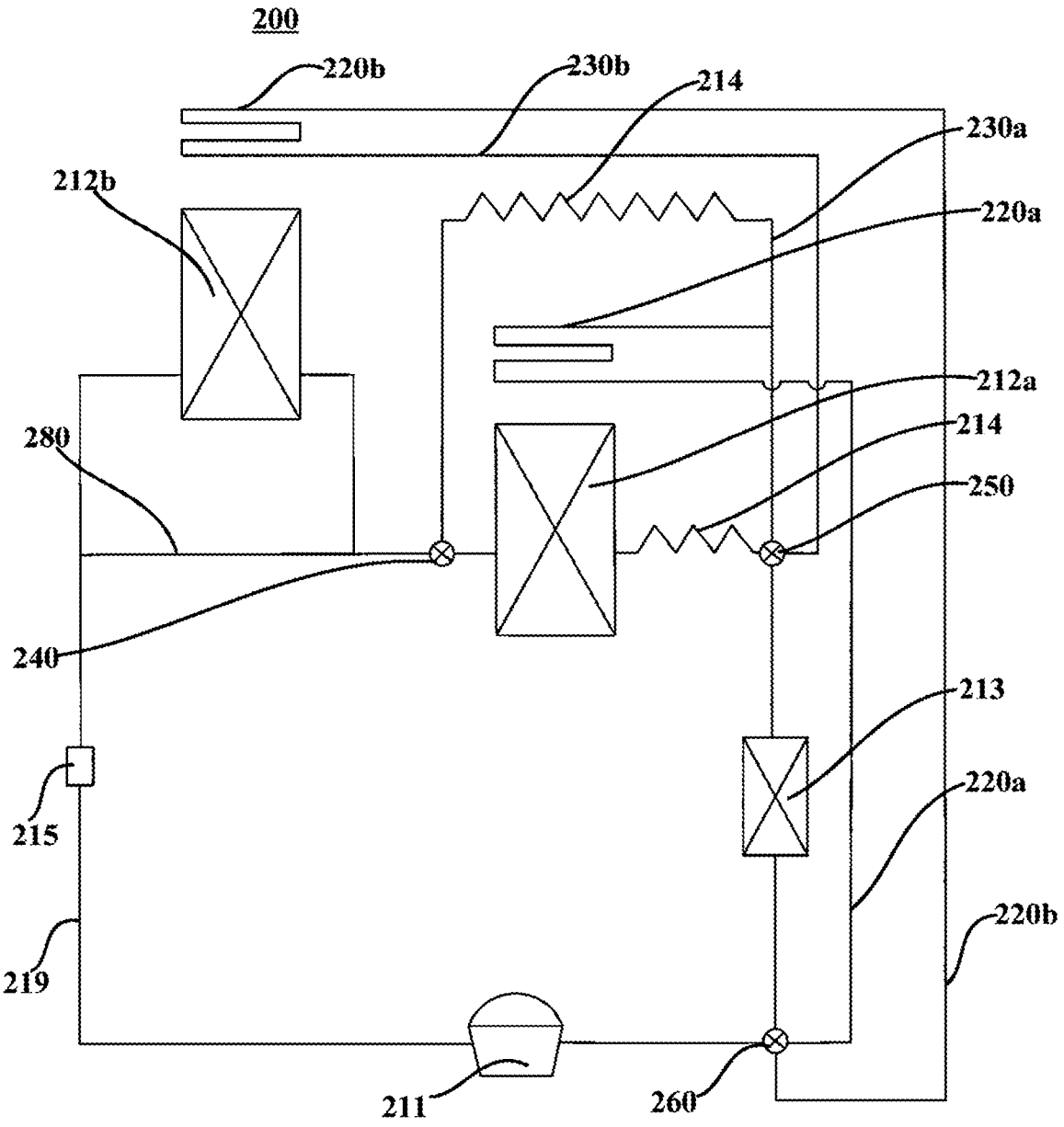
FIG. 4 is a schematic structural diagram of a refrigeration system for refrigerating appliance according to another embodiment of the present subject matter.

In other optional embodiments, for the refrigeration system 200 shown in FIG. 3, the structure of the refrigeration assembly 210, as well as the structure and connection manner of the cooling bypass pipelines, can be varied. FIG. 4 is a schematic structural diagram of a refrigeration system for refrigerating appliance according to another embodiment of the present subject matter.

In this embodiment, neither the first cooling bypass pipeline 230*a* nor the second cooling bypass pipeline 230*a* may require a bypass throttling device. In the refrigeration assembly 210, the refrigeration throttling device 214 can serve as a refrigeration throttling device 214 corresponding to the first evaporator 212*a*, and this refrigeration throttling device 214 and the first evaporator 212*a* being serially connected to form a first refrigeration branch. The refrigeration assembly 210 can further include an additional refrigeration throttling device 214 corresponding to the second evaporator 212*b*, and this refrigeration throttling device 214 is set in parallel with the first refrigeration branch and corresponds to the second evaporator 212*b*.

The outlet of the first cooling bypass pipeline 230*a* can be altered to connect to the inlet of the refrigeration throttling device 214 corresponding to the second evaporator 212*b*. The outlet of the second cooling bypass pipeline 230*b* can be altered to connect to the inlet of the refrigeration throttling device 214 corresponding to the first evaporator 212*a*. Correspondingly, the refrigeration system 200 can further include a third switching valve 250, which can be a dual-input and dual-output solenoid valve, that is, having two inlets and two outlets. For example, the third switching valve 250 may have an inlet connected to the outlet of the condenser 213 and an inlet connected to the outlet of the second cooling bypass pipeline 230*b*. The two outlets of the third switching valve 250 are each connected to one of the two refrigeration throttling devices 214. The third switching valve 250 can be disposed in the storage compartment 110.

When both the first evaporator 212*a* and the second evaporator 212*b* are providing cooling, the third switching valve 250 opens the inlet connected to the outlet of the condenser 213, and the second switching valve 260 opens at least one outlet connected to at least one refrigeration throttling device 214, and the first switching valve 240 opens the valve port connecting to the second evaporator 212*b*. When the first evaporator 212*a* is defrosting, the second switching valve 260 opens the valve port connecting to the first defrost bypass pipeline 220*a* and closes other valve ports, and all inlets and outlets of the third switching valve 250 are closed, and the first switching valve 240 opens the valve port connecting to the second evaporator 212*b*. When the second evaporator 212*b* is defrosting, the second switching valve 260 opens the valve port connecting to the second defrost bypass pipeline 220*b* and closes other valve ports, and the third switching valve 250 opens the inlet connected to the second cooling bypass pipeline 230*b* and the outlet connecting to the refrigeration throttling device 214 corresponding to the first evaporator 212*a*, and the first switching valve 240 opens the valve port connecting to the bypass return pipeline 280 and closes other valve ports.

By improving the structure of the refrigeration circuit and the bypass branch and using the third switching valve 250 to regulate the flow path of the refrigerant, the refrigeration system 200 can flexibly adjust the cooling effect of the first evaporator 212*a* and the second evaporator 212*b*, while also simplifying the structure of the cooling bypass pipelines. This allows each cooling bypass pipeline to omit the bypass throttling device.

In other optional embodiments, the number of refrigeration circuits can be varied. For example, an additional refrigeration circuit can be added to the refrigeration assembly. That is, this embodiment would have two refrigeration circuits: the first refrigeration circuit containing a series of a first compressor, a first condenser, a first throttling device, and a first evaporator, and the second refrigeration circuit containing a second compressor, a second condenser, a second throttling device, and a second evaporator. The second refrigeration circuit may also include a condenser heating pipe, connected between the condenser and the second throttling device. The condenser heating pipe is thermally connected to the first evaporator to heat it when the first evaporator requires defrosting. The first condenser is thermally connected to the second evaporator to heat it when the second evaporator requires defrosting.

Figure 5:
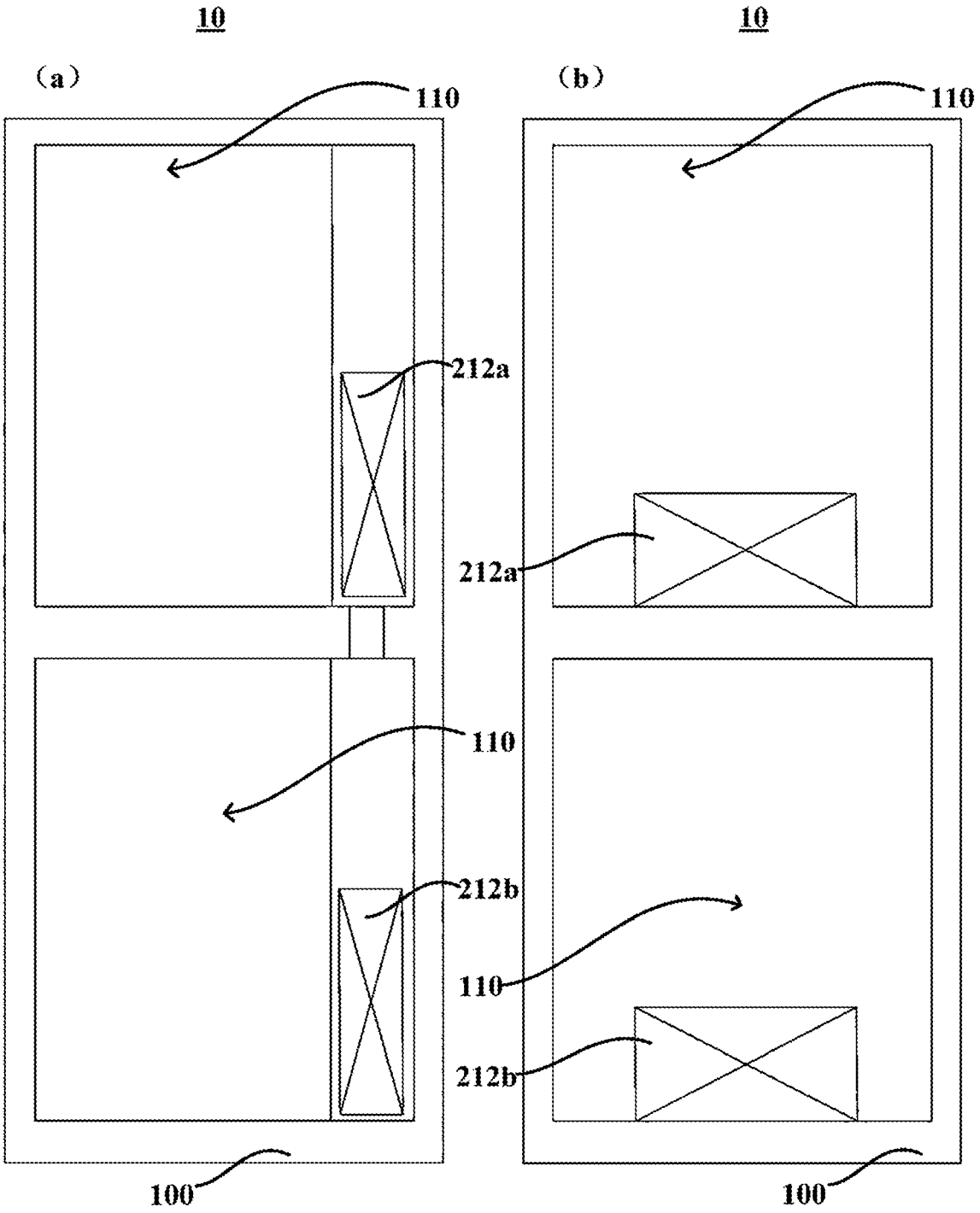
FIG. 5 is a schematic structural diagram of a refrigerating appliance according to an embodiment of the present subject matter.

FIG. 5 is a schematic structural diagram of a refrigerating appliance according to an embodiment of the present subject matter, wherein, (a) is a side view; (b) is the main view; the evaporator layout directions in (a) and (b) are slightly different.

The refrigerating appliance 10 generally includes a cabinet 100 and the refrigeration system 200 described in any of the above-mentioned embodiments. The evaporator 212 of the refrigeration system 200 is used to provide cooling to the storage compartment 110.

A storage compartment 110 is formed inside the cabinet 100. The evaporator 212 of the refrigeration system 200 is used to provide cooling to the storage compartment 110. There can be one storage compartment 110, and its temperature zone can be set according to actual needs. For example, the storage compartment 110 can be a refrigeration compartment, a freezing compartment, a cryogenic compartment, or a variable temperature compartment. The evaporators are used to provide cooling to the storage compartment 110. The first evaporator 212*a* and the second evaporator 212*b* are used to provide cooling to this storage compartment 110.

In this embodiment, the storage compartment 110 can also be multiple, for example, two storage compartments. The two storage compartments 110 can be set side by side or stacked vertically. There are two evaporators in the refrigeration system, namely the first evaporator 212*a* and the second evaporator 212*b*. Each storage compartment 110 is equipped with a corresponding evaporator. Each evaporator can be set behind or below its corresponding storage compartment 110. Each evaporator provides cooling to its corresponding storage compartment 110, and can also provide cooling to another storage compartment 110 through an air delivery duct for sharing cooling.

This embodiment introduces a new method of defrosting by improving the structure of the refrigeration system 200. By adding a defrost bypass pipeline 220 connected to the refrigeration circuit and thermally connecting it with the evaporator 212, the evaporator 212 can be heated for defrosting when the refrigerant from the compressor 211 flows through the defrost bypass pipeline 220. Since the refrigerant from the compressor 211 can produce a significant amount of heat when passing through the defrost bypass pipeline 220, this manner of defrosting can enhance the defrosting rate of the evaporator 212 and enable the defrosting to be quick, efficient, and thorough.

So far, it should be appreciated by those skilled in the art that while various exemplary embodiments of the utility model have been shown and described in detail herein, many other variations or modifications which are consistent with the principles of this utility model may be determined or derived directly from the disclosure of the present utility model without departing from the spirit and scope of the utility model. Accordingly, the scope of the utility model should be understood and interpreted to cover all such other variations or modifications.

What is claimed is:

1. A refrigeration system for a refrigerating appliance, comprising:

a refrigeration assembly comprising a compressor, a condenser, a first evaporator and a second evaporator, forming a refrigeration circuit, the first evaporator is serially connected upstream of the second evaporator, the condenser sets between the compressor and the evaporators; and a first defrost bypass pipeline corresponding to the first evaporator and a second defrost bypass pipeline corresponding to the second evaporator, connected to the refrigeration circuit for circulating refrigerant from the compressor to generate heat; the first defrost bypass pipeline is thermally connected with the first evaporator to heat the first evaporator, the second defrost bypass pipeline is thermally connected with the second evaporator to heat the second evaporator;

a first cooling bypass pipeline and a second cooling bypass pipeline, the first cooling bypass pipeline is connected to the first defrost bypass pipeline and guides the refrigerant flowing through the first defrost bypass pipeline to the second evaporator, enabling the second evaporator to produce cooling; the second cooling bypass pipeline is connected to the second defrost bypass pipeline and guides the refrigerant flowing through the second defrost bypass pipeline to the first evaporator, enabling the first evaporator to produce cooling; and a switching valve connected to an exhaust port of the compressor and having a valve port connecting to the condenser and allowing the refrigerant flowing out of which to flow towards the condenser, a valve port connecting to the first defrost bypass pipeline and allowing the refrigerant flowing out of which to flow towards the first defrost bypass pipeline, and a valve port connecting to the second defrost bypass pipeline and allowing the refrigerant flowing out of which to flow towards the second defrost bypass pipeline.

2. The refrigeration system of claim 1, wherein the refrigeration assembly further comprises a refrigeration throttling device set within the refrigeration circuit and connected to an inlet of the first evaporator; the refrigeration throttling device throttle the refrigerant flowing from the condenser to the first evaporator.

3. The refrigeration system of claim 1, wherein the refrigeration assembly further comprises a return pipe set within the refrigeration circuit and connecting an outlet of the second evaporator to a suction port of the compressor.

4. The refrigeration system of claim 3, wherein the outlet of the defrost bypass pipeline is connected to the return pipe.

5. The refrigeration system of claim 1, wherein the defrost bypass pipelines are either coiled around the corresponding evaporators or set up adjacent to the corresponding evaporators.

6. A refrigerating appliance, comprising:

a cabinet forming a storage compartment inside; and a refrigeration system of claim 1; where the evaporators provide cooling to the storage compartment.

7. The refrigeration system of claim 2, wherein the first cooling bypass pipeline is connected to an inlet of the second evaporator and is equipped with a first bypass throttling device used for throttling the refrigerant flowing towards the second evaporator; when the first evaporator is defrosting using the heat generated by the first defrost bypass pipeline, the first cooling bypass pipeline utilizes the first bypass throttling device to throttle the refrigerant exiting the first defrost bypass pipeline and flowing towards the second evaporator.

8. The refrigeration system of claim 2, wherein the second cooling bypass pipeline is connected to an inlet of the first evaporator and is equipped with a second bypass throttling device used for throttling the refrigerant flowing towards the first evaporator; when the second evaporator is defrosting using the heat generated by the second defrost bypass pipeline, the second cooling bypass pipeline utilizes the second bypass throttling device to throttle the refrigerant exiting the second defrost bypass pipeline and flowing towards the first evaporator.

9. The refrigeration system of claim 2, wherein the refrigeration throttling device is corresponding to the first evaporator, and being serially connected to form a first refrigeration branch with the first evaporator, wherein the refrigeration assembly further comprises an additional refrigeration throttling device corresponding to the second evaporator, and the additional refrigeration throttling device is set in parallel with the first refrigeration branch and corresponds to the second evaporator, and wherein an outlet of the first cooling bypass pipeline is altered to connect to an inlet of the additional refrigeration throttling device.

10. The refrigeration system of claim 9, wherein further comprises a third switching valve, having an inlet connected to an outlet of the condenser, an inlet connected to an outlet of the second cooling bypass pipeline, an outlets connected to the refrigeration throttling device, and an outlets connected to the additional refrigeration throttling device.

11. The refrigeration system of claim 3, further comprising a bypass return pipeline, which connects an outlet of the first evaporator to a suction port of the compressor.

* * * * *